US005337906A

United States Patent [19]

Digiulio

[11] Patent Number: 5,337,906

[45] Date of Patent: Aug. 16, 1994

[54] WALL SECRETARY

[76] Inventor: Neil N. Digiulio, 1307 W. Church St., Elmira, N.Y. 14905

[21] Appl. No.: 49,368

[22] Filed: Apr. 21, 1993

[51] Int. Cl.[5] ..... A47F 7/00

[52] U.S. Cl. ..... 211/88; 211/69.1

[58] Field of Search ..... 211/88, 50, 69.1, 75; 248/205.3

[56] References Cited

U.S. PATENT DOCUMENTS

| | | | |
|---|---|---|---|
| 67,209 | 5/1925 | Kaufman | 211/88 X |
| 83,884 | 11/1868 | Saurman | 211/88 X |
| D. 191,924 | 12/1961 | Meade et al. | 211/88 X |
| 4,305,512 | 12/1981 | Mackenzie | 211/75 |
| 5,188,242 | 2/1993 | Smith | 248/205.3 X |
| 5,232,103 | 8/1993 | Koenig et al. | 248/205.3 X |

*Primary Examiner*—Alvin C. Chin-Shue
*Assistant Examiner*—Sarah A. Lechok

[57] ABSTRACT

A wall-mounted device to provide storage for and convenient access to secretarial items such as pens, pencils, writing pads, keys, etc. The device may be mounted on any vertical surface including the box of a telephone and will hold such items so as to be convenient for the user.

8 Claims, 5 Drawing Sheets

WALL SECRETARY

BACKGROUND OF THE INVENTION

1. Field of the Invention

The present invention relates to utensil holders and more particularly pertains to a holding device which is particularly adapted to hold secretarial needs in such manner as to keep them segregated one from another and yet convenient for a user.

2. Description of the Prior Art

The use of pencil holders or the like is known in the prior art. More specifically, holders heretofore devised and utilized for the purpose of storing secretarial needs are known to consist basically of familiar, expected and obvious structural configurations, notwithstanding the myriad of designs encompassed by the crowded prior art which have been developed for the fulfillment of countless objectives and requirements.

Nearly everyone has experienced the frustration of answering a telephone and receiving a message which required writing down but nothing to write with or on is at hand. Pencil or pen holders consisting of horizontal tubes into which the writing implement is inserted for storage are well known. Most of these clip onto the frame of a telephone receiver. Typical of these are the units disclosed in U.S. Pat. No. 4,077,521 or U.S. Pat. No. 254,253. Such holders in a wall-mounted mode are also known in the fabric holder magnetically secured to a metal surface shown in U.S. Pat. No. 4,736,853. Still other holders are illustrated in U.S. Pat. No. 4,630,953 and No. 4,522,522.

In this respect, the holder according to the present invention substantially departs from the conventional concepts and designs of the prior art, and in so doing provides an apparatus primarily developed for the purpose of being a complete wall mounted secretary.

Therefore, it can be appreciated that there exists a continuing need for new and improved holders which can be mounted on any vertical surface. In this regard, the present invention substantially fulfills this need.

SUMMARY OF THE INVENTION

In view of the foregoing disadvantages inherent in the known types of pencil, pen or the like holder now present in the prior art, the present invention provides an improved holder construction wherein the same can be utilized .... As such, the general purpose of the present invention, which will be described subsequently in greater detail, is to provide a new and improved wall-mounted secretarial device which has all the advantages of the prior art pencil holders and none of the disadvantages.

To attain this, the present invention essentially comprises a permanent wall-mount device which will hold items such as pens, pencils, or the like in such manner as to prevent accidental dropping thereof and which furthermore will be capable of holding items such as paper clips, keys or the like if desired. In its preferred embodiment it will also provide a note pad inclined to permit ease of use and means to both illuminate the device and to alert one to the fact that a message is on such pad.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pencil and similar object holder which has all the advantages of the prior art devices and none of the disadvantages.

It is another object of the present invention to provide a new and improved wall-mounted secretary which may be easily and efficiently manufactured and marketed.

It is a further object of the present invention to provide a new and improved secretarial need holding device which is of a durable and reliable construction.

An even further object of the present invention is to provide a new and improved wall-mounted secretary which is susceptible of a low cost of manufacture with regard to both materials and labor, and which accordingly is then susceptible of low prices of sale to the consuming public, thereby making such units economically available to the buying public.

Still another object of the present invention is to provide a new and improved device which may be associated with a telephone to eliminate difficulty in recording messages received therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
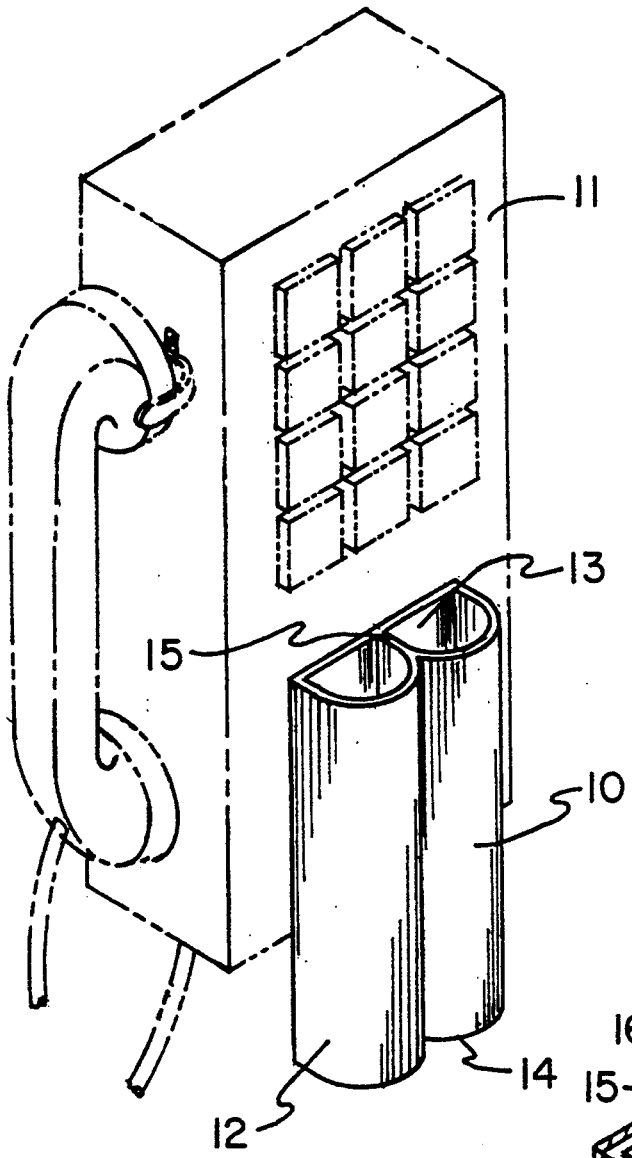
FIG. 1 is a perspective view showing the simplest form of the device of the present invention mounted on a wall telephone.

With reference now to the drawings, and in particular to FIG. 1 thereof, a new and improved wall-mounted secretary embodying the principles and concepts of the present invention and generally designated by the reference numeral 10 will be described.

The basic unit 10 of the device of the present invention is shown affixed to the flat vertical surface of a wall-mounted telephone 11. As shown here in its simplest form, unit 10 consists of two tubular members or receptacles 12 having a common flat back wall 13 and an arcuate shaped front wall 14. A common wall 15 divides the two tubular members which are open at the top and closed at the base. The unit 10 is shown prior to installation in FIG. 2. Also shown in this view is the non-stick liner 16 covering a layer of permanent-type pressure sensitive adhesive 17 on the exterior of the back wall 13. For the sake of convenience, reference numerals throughout these drawings remain constant for the components identified therein.

Figure 2:
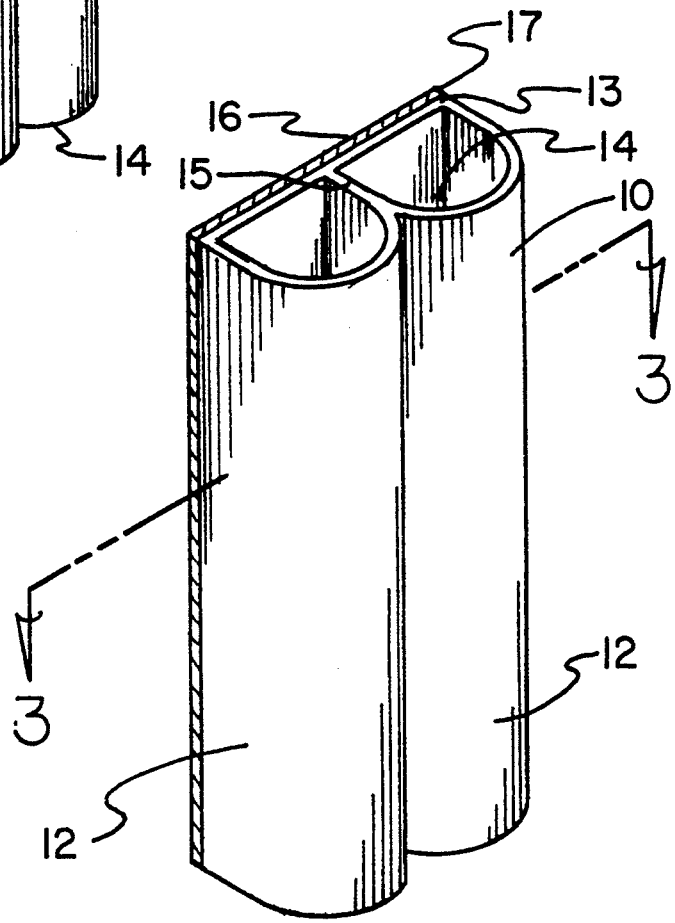
FIG. 2 is a perspective view of the device in FIG. 1 before it is mounted on a vertical surface.
Figure 3:
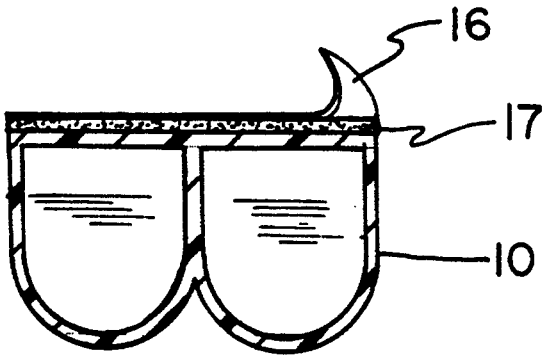
FIG. 3 is a sectional view taken on line 3—3 of FIG. 2.

FIG. 3, a sectional view taken on line 3—3 of FIG. 2, illustrates in more detail the adhesive layer 17 and removable liner 16 covering the same. In usage, liner 16 is peeled away from the adhesive layer 17 as shown in this figure and then unit 10 is pressed against the desired flat surface to which it is to be mounted (as, for instance, the telephone in FIG. 1). The unit 10 is manufactured from rigid material such as stiff plastic to prevent deformation thereof and to provide durability therefor. The adhesive is designed to permanently affix unit 10 to the surface to which it is applied.

Figure 4:
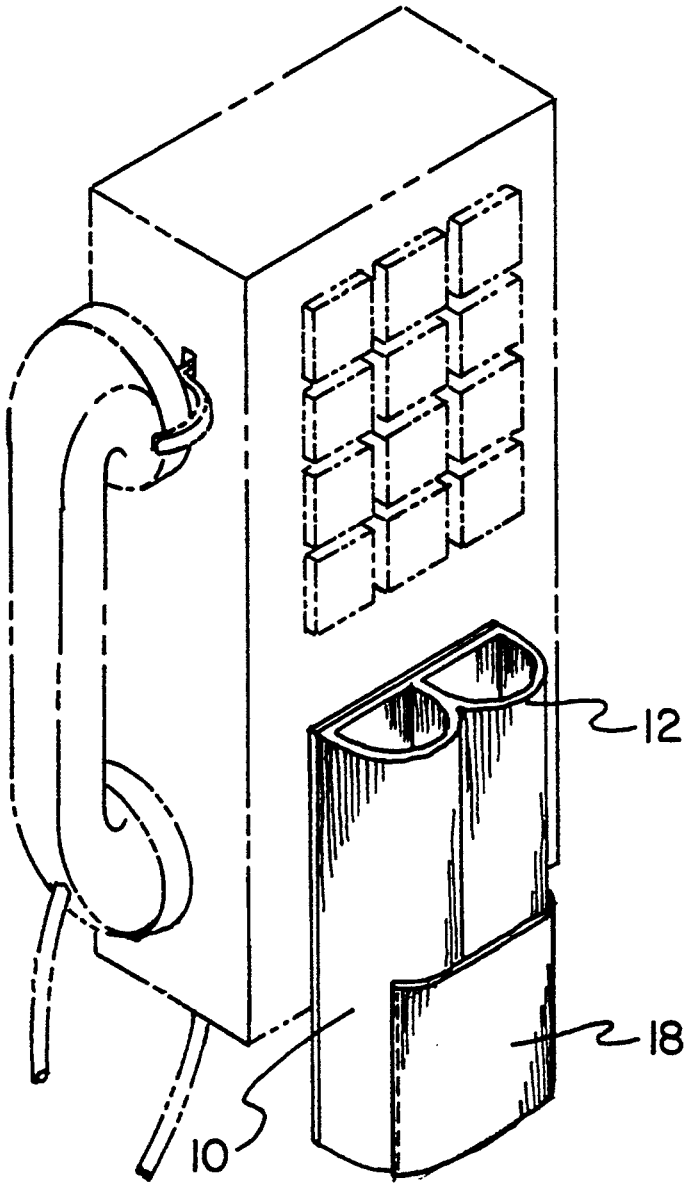
FIG. 4 is a similar view to that of FIG. 1 illustrating an additional variation of the invention.

FIG. 4 shows a modification of unit 10 wherein a pouch 18 of flexible, stretchable material is affixed to the outer arcuate front walls of tubular member 12. Adhesive is the preferred means for attachment of pouch 18. Being stretchable it may be used to contain such items as paper clips, rubber bands or other small easy-to-lose items.

Figure 5:
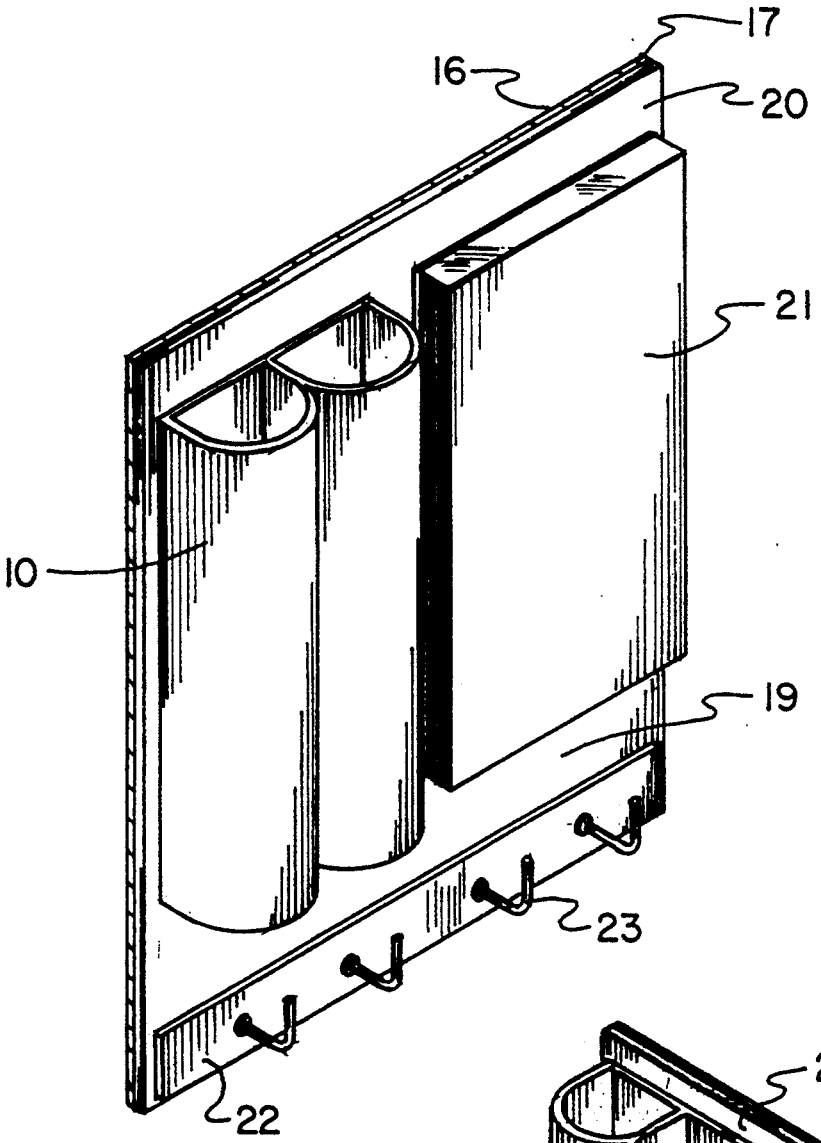
FIG. 5 is a perspective view of another form of the invention.

In FIG. 5, unit 10, instead of being a separate unit as in the preceding drawings, is shown as a component of a more elaborate wall secretary 19 which comprises a flat vertical surface member 20 having the adhesive layer 17 and associated liner 16 on the back thereof. Unit 10 is mounted on this flat member 20 as to any vertical wall surface. Mounted on member 20 in close association with unit 10 is a memo pad 21 adhesively secured to member 20. In this modification, a further narrow strip 22 of rigid material is secured to and across the bottom portion of member 20. Affixed to and projecting from strip 22 are a plurality of hook members 23 adapted to having keys or the like hung therefrom.

Figure 6:
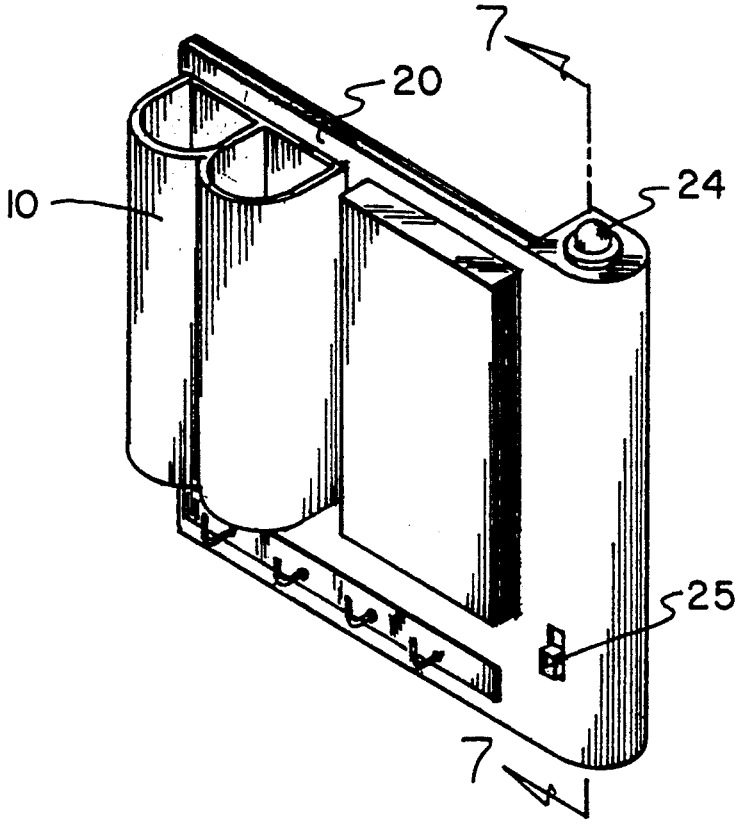
FIG. 6 is a perspective view of the device shown in FIG. 5 with the addition of another variation thereto.

FIG. 6 shows a modification of the device of FIG. 5 wherein an indicator light 24 and an associated on-off switch 25 are mounted within a curved cylindrical chamber 26 formed as an extension of member 20. This device is designed to mount on the end or edge of a vertical wall to permit the curved chamber 26 to extend around such wall while the rest of member 20 is positioned flat against such wall.

Figure 7:
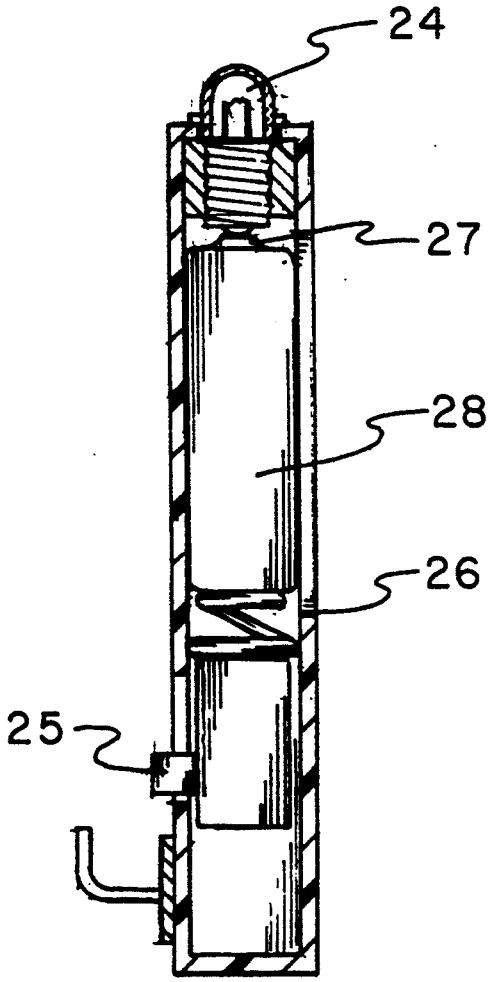
FIG. 7 is a sectional view taken on line 7—7 of FIG. 6.
Figure 8:
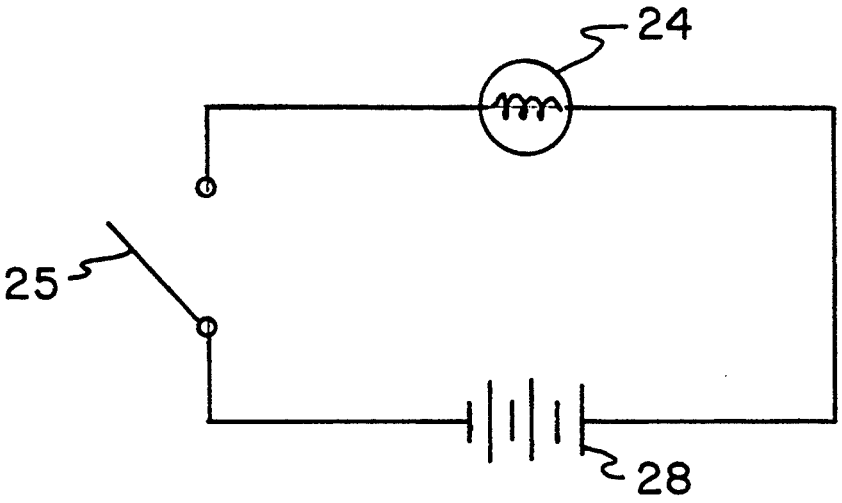
FIG. 8 is a simplified circuit diagram for the device in FIG. 7.

FIG. 7, taken on line 7—7 of FIG. 6, shows, in cross-section, the light 24 and its associated components. In this version light 24 is activated by engagement at its base with the terminal 27 of a battery 28 enclosed within curved chamber 26. Battery 28 provides the power to actuate light 24 through conventional circuitry as shown in FIG. 8.

Figure 9:
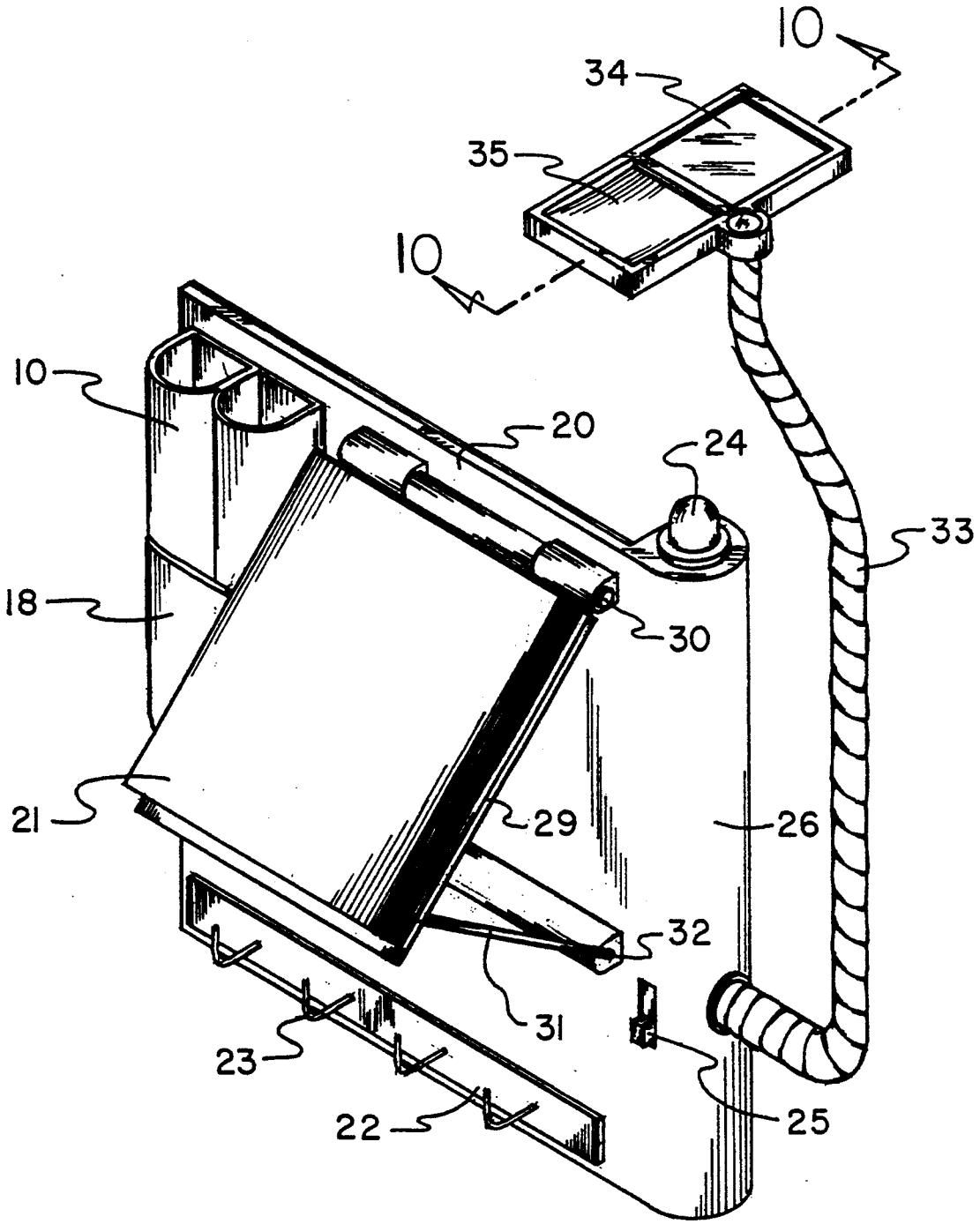
FIG. 9 illustrates the preferred form of the present invention.
Figure 10:
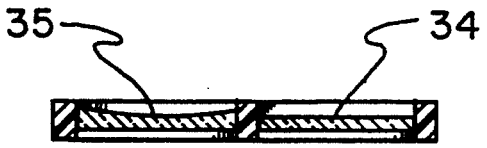
FIG. 10 is a sectional view on line 10—10 of FIG. 9.

FIG. 9 and 10 represent the preferred embodiment of the present invention. Herein the components illustrated in the preceding figures are brought together along with the addition of a further element and the modification of another. The descriptions in the discussions of the previous figures suffice for flat, vertical surface member 20, unit 10, pouch 18, strip 22 and its associated hook members 23, and light 24 and switch 25 contained within curved chamber 26. An improved version of memo pad 21 is provided wherein such pad 21 is provided with a hinged rigid pad support member 29, connected to surface member 20 by hinges 30, and supported angularly out at its lower end from member 20 by a slidable brace member 31. Brace member 31 is pivotally connected to vertical surface member 20 as at 32 to permit brace member 31 to slide up the back of pad support member 29 to a position parallel with the vertical surface of member 20. This permits pad 21 to be dropped from its angulated position to lie flat against member 20 and thus be out of the way when not in use. Also shown in this figure, attached at its lower end to the curved chamber 26, is a bendable tubular flex cable member 33 formed of metal or plastic as readily obtainable commercially. Such flex cable member 33 is bendable into various configurations and will maintain such configuration until deliberately rebent. Swivelly mounted at the upper free end of cable member 33 are a pair of mirrors 34 and 35. As shown in FIG. 10, mirror 34 is planar in nature while mirror 35 has a concave surface. By bending flexible member 33, either of these mirrors 34 or 35 can be brought into play, reflecting the beams from light 24 downwardly onto the surface of inclined pad 21 to permit better visibility for writing thereon. Mirror 35 will direct a more concentrated beam of light where one is desired.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved wall secretary device which comprises: a pair of rigid, open-top, closed bottom, vertical receptacles affixed together in parallel and having a flat surface forming one common wall for said pair of receptacles; said vertical receptacles further having a pair of cylindrical surfaces forming another common wall therefor opposed with respect to said flat surface; a permanent pressure-sensitive adhesive coating of the back of said flat surface remote from said receptacles; and a peelable, non-stick liner covering such adhesive coating.

2. A new and improved wall secretary device which comprises: a pair of rigid, open-top, closed bottom, vertical receptacles affixed together in parallel and having a flat surface forming one common wall for said pair of receptacles; a permanent pressure-sensitive adhesive coating of the back of said flat surface remote from said receptacles; and a peelable, non-stick liner covering such adhesive coating, wherein a pocket of flexible stretchable material is affixed to the outer surfaces of said receptacles.

3. A new and improved wall secretary device which comprises: a pair of rigid, open-top, closed bottom, vertical receptacles affixed together in parallel and having a flat surface forming one common wall for said pair of receptacles; a permanent pressure-sensitive adhesive coating of the back of said flat surface remote from said receptacles; and a peelable, non-stock liner covering such adhesive coating, wherein said flat surface of said receptacle is secured to a second larger flat surface; a memo pad secured to said second flat surface in close proximity to said receptacles; and a flat strip secured to said second flat surface below said receptacles, said flat strip having mounted thereon a plurality of object-holding hooks.

4. A device as in claim 3 wherein said second flat surface terminates at one end thereof in a curved cylindrical chamber; and means for providing illumination at the top of said chamber.

5. A device as in claim 4 wherein said means for providing illumination comprises a light bulb positioned externally of the top of said curved, cylindrical chamber, a battery positioned within said chamber having its terminal in contact with the base of said light bulb and an external switch mounted on said chamber to make or break a circuit between said battery and said light bulb.

6. A device as in claim 5 wherein a bracket member is pivotally affixed to said second flat surface in slidable engagement with a flat plate supporting said memo pad, said bracket being adjustable to hold said flat plate and memo pad in angular relationship to said second flat surface.

7. A device as in claim 6 wherein a bendable tubular flex member is affixed to the outside of said curved, cylindrical chamber and extends upwardly therefrom; a pair of mirrors swivelly affixed to the free end of such tubular flex member and adjustable thereon to catch and reflect back to said memo pad the light emitted by said light bulb.

8. A device as in claim 7 wherein one of said mirrors is planar and the other of said mirrors has a concave surface.

* * * * *